US012110639B1

(12) United States Patent
Wu et al.

(10) Patent No.: US 12,110,639 B1
(45) Date of Patent: Oct. 8, 2024

(54) RAIL TEMPERATURE EXPANSION JOINT AND LAYING AND MOUNTING METHOD

(71) Applicant: China Railway First Group Co., LTD, Xi'an (CN)

(72) Inventors: Huihuo Wu, Xi'an (CN); Zifei Guo, Xi'an (CN); Fei Li, Xi'an (CN); Hong Xu, Xi'an (CN); Zhifeng Gao, Xi'an (CN); Ziyong Yu, Xi'an (CN); Fei Zhang, Xi'an (CN); Tailong Yin, Xi'an (CN)

(73) Assignee: China Railway First Group Co., LTD, Xi'an (CN)

( * ) Notice: Subject to any disclaimer, the term of this patent is extended or adjusted under 35 U.S.C. 154(b) by 0 days.

(21) Appl. No.: 18/663,099

(22) Filed: May 14, 2024

(30) Foreign Application Priority Data

Sep. 1, 2023 (CN) ..... 202311125362.9

(51) Int. Cl.

| | |
|---|---|
| ***E01B 11/10*** | (2006.01) |
| ***E01B 11/00*** | (2006.01) |
| ***E01B 11/16*** | (2006.01) |
| ***E01B 11/20*** | (2006.01) |
| ***E01B 11/34*** | (2006.01) |
| ***E01B 11/38*** | (2006.01) |
| ***E01B 31/02*** | (2006.01) |

(52) U.S. Cl.
CPC ..... *E01B 11/10* (2013.01); *E01B 11/00* (2013.01); *E01B 11/16* (2013.01); *E01B 11/20* (2013.01); *E01B 11/34* (2013.01); *E01B 11/38* (2013.01); *E01B 31/02* (2013.01)

(58) Field of Classification Search
CPC ..... E01B 11/10; E01B 11/16; E01B 11/20; E01B 11/34; E01B 11/38; E01B 11/00; E01B 31/02
USPC ..... 238/151, 171, 228
See application file for complete search history.

(56) References Cited

U.S. PATENT DOCUMENTS 4,967,669 A * 11/1990 Kuchta ..... B65G 21/22 198/816

FOREIGN PATENT DOCUMENTS

| | | | | |
|---|---|---|---|---|
| CN | 201089872 | Y | | 7/2008 |
| CN | 214497026 | U | * | 10/2021 |
| CN | 113931015 | A | * | 1/2022 |
| CN | 114541186 | A | * | 5/2022 |
| CN | 114775341 | A | | 7/2022 |
| CN | 217808361 | U | | 11/2022 |
| CN | 218371313 | U | | 1/2023 |
| CN | 218747705 | U | | 3/2023 |

(Continued)

*Primary Examiner* — S. Joseph Morano
*Assistant Examiner* — James William Jones
(74) *Attorney, Agent, or Firm* — Bayramoglu Law Offices LLC

(57) ABSTRACT

A rail temperature expansion joint and a laying and mounting method thereof relate to the technical field of track transit. The rail temperature expansion joint includes a sleeper, the upper surface of the sleeper is symmetrically mounted with two first rails and two second rails, and the first rail and the second rail on one side are arranged on the same straight line; a gap is arranged between end faces of the first rail and the second rail; the adjacent ends of the first rail and the second rail are fastened and positioned by a group of adjustment components, the adjustment components are fixedly mounted on the embedded part, and the embedded part is located at the outer side of the first rail and the second rail.

15 Claims, 3 Drawing Sheets

(56) References Cited

FOREIGN PATENT DOCUMENTS

| | | | | |
|---|---|---|---|---|
| JP | 3171893 | U | | 11/2011 |
| KR | 200208333 | Y1 | * | 12/2000 |
| KR | 20010075783 | A | * | 8/2001 |
| KR | 100991269 | B1 | | 11/2010 |
| WO | 2018081962 | A1 | | 5/2018 |
| WO | WO-2019195925 | A1 | * | 10/2019 |

* cited by examiner

RAIL TEMPERATURE EXPANSION JOINT AND LAYING AND MOUNTING METHOD

CROSS REFERENCE TO THE RELATED APPLICATIONS

This application is based upon and claims priority to Chinese Patent Application No. 202311125362.9, filed on Sep. 1, 2023, the entire contents of which are incorporated herein by reference.

TECHNICAL FIELD

The present disclosure relates to the technical field of track transit, in particular to a rail temperature expansion joint and a laying and mounting method thereof.

BACKGROUND

Rail temperature expansion joint, also known as rail expansion joint, is a device for adjusting rail expansion. A rail expansion joint is installed on the track, which can adjust the expansion and contraction of the track line by utilizing the relative dislocation of the switch rail or the basic rail. It is commonly used on longspan steel girder bridges, bridge-heads and seamless rail where the rail expansion and contraction needs to be adjusted.

The existing rail temperature expansion joint has a simple structure, usually uses more than one steel plate to connect two sets of rails. The steel plate is easy to break when pulled for a long time. Meanwhile, the steel plate has high toughness and small adjustment range, and is easily deformed by pulling and extrusion.

It is an urgent technical problem for those skilled in the art to solve how to provide a rail temperature expansion joint and a laying and mounting method thereof to realize great adjustment, prolong the service life and improve the safety and stability.

SUMMARY

The object of the present disclosure is to provide a rail temperature expansion joint and a laying and mounting method thereof to solve the problems listed in the background.

In order to achieve the above effects, the present disclosure adopts the following technical solutions.

A rail temperature expansion joint of the present disclosure includes a sleeper, an upper surface of the sleeper is symmetrically mounted with two first rails and two second rails, and the first rail and the second rail on one side are arranged on a same straight line; a gap is arranged between end faces of the first rail and the second rail; adjacent ends of the first rail and the second rail are fastened and positioned by a group of adjustment components, the adjustment components are fixedly mounted on an embedded part, and the embedded part is located at an outer side of the first rail and the second rail.

Preferably, the adjustment component includes a side plate, a sliding groove, a support rod, a sliding plate, a first pillar, a second pillar, a connecting rod and a buffer spring; the side plate is arranged on an outer side of the first rail and the second rail; an inside of the side plate is provided with two sliding grooves, an inside of the sliding groove is fixedly connected with the support rod, an outer peripheral surface of the support rod is sleeved with the sliding plate and the buffer spring; the sliding plate is mounted in an inner cavity of the sliding groove in a sliding manner, one end of the buffer spring is fixedly connected inside the sliding groove, an other end of the buffer spring abuts against the sliding plate, and an outer side surface of the sliding plate is fixedly connected with the first pillar; outer side surfaces of the first rail and the second rail are fixedly connected with the second pillar, and the first pillar and the second pillar at the same height are sleeved with the connecting rod.

Preferably, two connecting rods are provided and are arranged in parallel up and down.

Preferably, two groups of clamping plates are fixedly connected to a bottom end of the side plate, one group of the clamping plates is connected to the first rail, an other group of the clamping plate is connected to the second rail, and each group of clamping plates is equipped with two.

Preferably, the clamping plate includes a connecting plate and two L-shaped resisting plates which are connected into a whole, the connecting plate is fixedly connected with the side plate, the two L-shaped resisting plates are fixedly mounted on an upper surface of the connecting plate, and the two L-shaped resisting plates are respectively positioned on an inner side surface and an outer side surface of the first rail and the second rail, and a height of the L-shaped resisting plates positioned on the inner sides of the first rail and the second rail is smaller than that of the L-shaped resisting plates positioned on the outer sides of the first rail and the second rail, and the height of the inner L-shaped resisting plate is matched with thicknesses of bottom edges of the first rail and the second rail.

Preferably, side springs are respectively connected between the outer side of the first rail and the L-shaped resisting plate and between the outer side of the second rail and the L-shaped resisting plate; one end of the side spring is welded on a side surface of the L-shaped resisting plate, and an other end of the side spring is welded on the outer side surface of the first rail and the outer side surface of the second rail.

Preferably, a plurality of fixed seats are fixedly mounted on an outer side surface of a bottom of the side plate, and the fixed seats are in threaded connection with embedded parts through fixed bolts.

Preferably, an outer side of the embedded part is fixedly connected with a plurality of clamping plates, and the clamping plates are fastened on roadbed through clamping nails.

The laying and mounting method of the rail temperature expansion joint as described above includes the following steps.

- S1, measuring a mounting spacing between a first rail and a second rail, and forming an embedded groove;
- S2, mounting an embedded part in the embedded groove;
- S3, mounting an adjustment component at a top end of the embedded part in an alignment manner, and connecting a side plate with the first rail and the second rail; and
- S4, mounting clamping plates at bottom ends of the first rail, the second rail and the side plate, and mounting side springs.

Preferably, in S1, digging embedded grooves symmetrically on both sides of the junction of the first rail and the second rail according to the measured spacing, a depth of the embedded grooves is greater than a height of the embedded part, placing the embedded part into the embedded groove and fixing the embedded part into the embedded groove by utilizing a clamping nail, then filling gravel cement and reserving a connecting hole;

in S2, placing the side plate in position above the embedded part, and connecting the fixed seat to the reserved connecting hole on the embedded part through a fixed bolt;

in S3, mounting connecting rods into a first pillar on an inner side of the side plate, as well as a second pillar on an outer side of the first rail and the second rail; and in S4, clamping the clamping plate at bottom sides of the first rail and the second rail, and welding the side springs between the first rail, the second rail and an L-shaped resisting plate at a top end side of the clamping plate.

Compared with the prior art, the beneficial effects of the present disclosure are as follows.

1) a rail temperature expansion joint connects a first rail and a second rail with a side plate through two groups of connecting rods, so that when a train passes by, the connecting rods drive a sliding plate to slide in a sliding groove at the outer end of the side plate, meanwhile, the buffer spring stretches, and the elastic force generated by the buffer spring prevents the train from derailing due to an overlarge gap generated when the first rail and the second rail are pulled; and the connecting rod connects the first rail and the second rail, compared with steel plate connection, the connecting rod has longer service life and is not easy to break; and 2) a rail temperature expansion joint clamps the bottoms of the first rail and the second rail through a clamping plate, so that the rails are always attached to the ground when the first rail and the second rail are extruded which preventing the first rail and the second rail from arching inward, thereby improving the safety when the train passes by; the embedded parts are arranged to enhance the stability of the connection of the side plates and prevent the side plates from loosening due to the vibration caused by the passing of a train.

In general, the rail temperature expansion joint and the laying and mounting method thereof of the present disclosure, connect a first rail and a second rail with a side plate through two groups of connecting rods, so that when a train passes by, the connecting rods drive a sliding plate to slide in a sliding groove at the outer end of the side plate, meanwhile, the buffer spring stretches, and the elastic force generated by the buffer spring prevents the train from derailing due to an overlarge gap generated when the first rail and the second rail are pulled; and the connecting rod connects the first rail and the second rail, compared with steel plate connection, the connecting rod has longer service life and is not easy to break which greatly improving the safety and stability in the running process of the train.

BRIEF DESCRIPTION OF THE DRAWINGS

The present disclosure will be further described below with reference to the accompanying drawings

Figure 1:
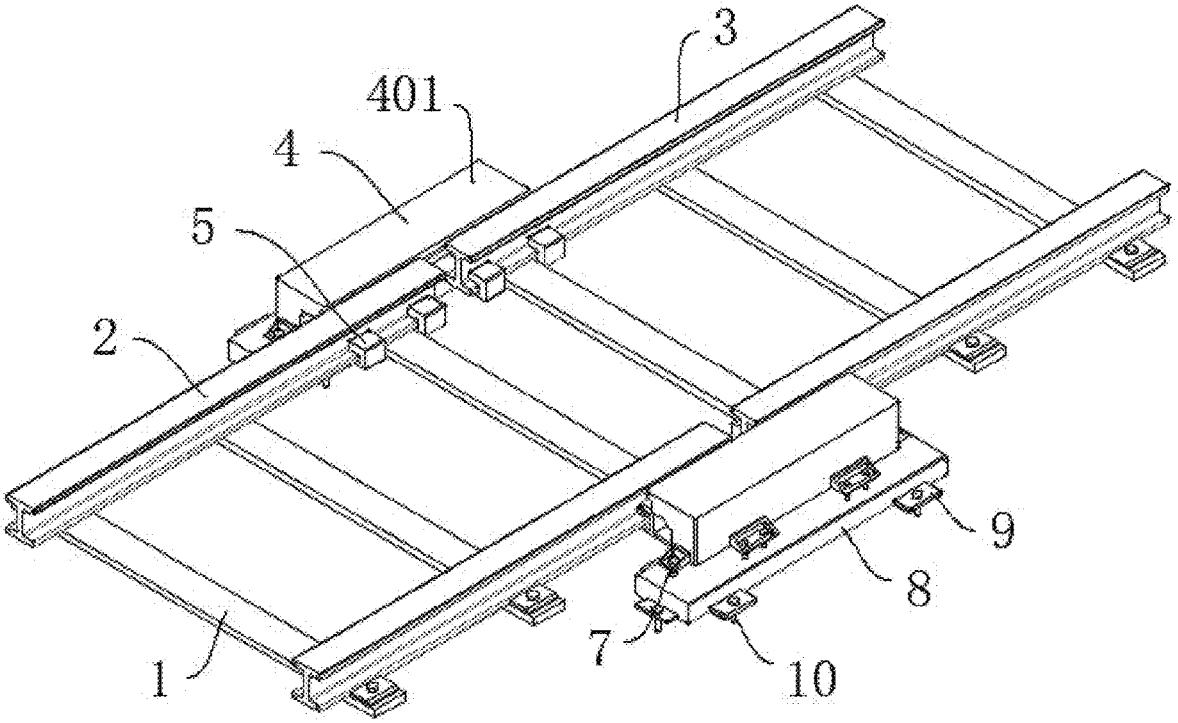
FIG. 1 is a perspective view of an external structure of a the rail temperature expansion joint of the present disclosure.

Description of reference numerals: 1—sleeper, 2—first rail, 3—second rail, 4—adjustment component, 401—side plate, 402—sliding groove, 403—support rod, 404—sliding plate, 405—first pillar, 406—second pillar, 407—connecting rod, 408—buffer spring, 5—clamping plate, 6—side springs, 7—fixed seat, 8—embedded part, 9—clamping plate, 10—clamping nail, and 11—fixed bolt.

DETAILED DESCRIPTION OF THE EMBODIMENTS

In order to make the technical problems, technical solutions and beneficial effects to be solved of the present disclosure more clear, the present disclosure will be further described in detail below with reference to the drawings and embodiments. It is to be understood that the specific embodiments described herein are merely illustrative of the disclosure and are not intended to limit the disclosure.

As shown in FIGS. 1-6, the rail temperature expansion joint includes a sleeper 1, the upper surface of the sleeper 1 is symmetrically mounted with two first rails 2 and two second rails 3, and the first rail 2 and the second rail 3 on one side are arranged on the same straight line; a gap is arranged between end faces of the first rail 2 and the second rail 3; the adjacent ends of the first rail 2 and the second rail 3 are fastened and positioned by a group of adjustment components 4, the adjustment components 4 are fixedly mounted on the embedded part 8, and the embedded part 8 is located at the outer side of the first rail 2 and the second rail 3.

As shown in FIGS. 2-5, the adjustment component 4 includes a side plate 401, a sliding groove 402, a support rod 403, a sliding plate 404, a first pillar 405, a second pillar 406, a connecting rod 407 and a buffer spring 408; the side plate 401 is arranged on the outer side of the first rail 2 and the second rail 3; the inside of the side plate 401 is provided with two sliding grooves 402, the inside of the sliding groove 402 is fixedly connected with the support rod 403, the outer peripheral surface of the support rod 403 is sleeved with the sliding plate 404 and the buffer spring 408; the sliding plate 404 is mounted in the inner cavity of the sliding groove 402 in a sliding manner, the end of the buffer spring 408 is fixedly connected inside the sliding groove 402, and the other end of the buffer spring 408 abuts against the sliding plate 404. When the sliding plate 404 slides at the outer end of the support rod 403, the buffer spring 408 is repeatedly compressed and extended, and the elastic force generated by the buffer spring 408 reduces the stretching and extrusion amount of the first rail 2 and the second rail 3, thereby enhancing the safety and stability when the train passes by. The outer side surface of the sliding plate 404 is fixedly connected with the first pillar 405; the outer side surfaces of the first rail 2 and the second rail 3 are fixedly connected with the second pillar 406, and the first pillar 405 and the second pillar 406 at the same height are sleeved with the connecting rod 407. When a train passes by, the first rail 2 and the second rail 3 are pulled or squeezed, at this time, the connecting rod 407 drives the sliding plate 404 to slide inside the sliding groove 402, and the sliding plate 404 slides at the outer end of the support rod 403.

Specifically, two connecting rods 407 are provided and are arranged in parallel up and down, so that the longitudinal deformation of the first rail 2 and the second rail 3 is relatively small.

Figure 2:
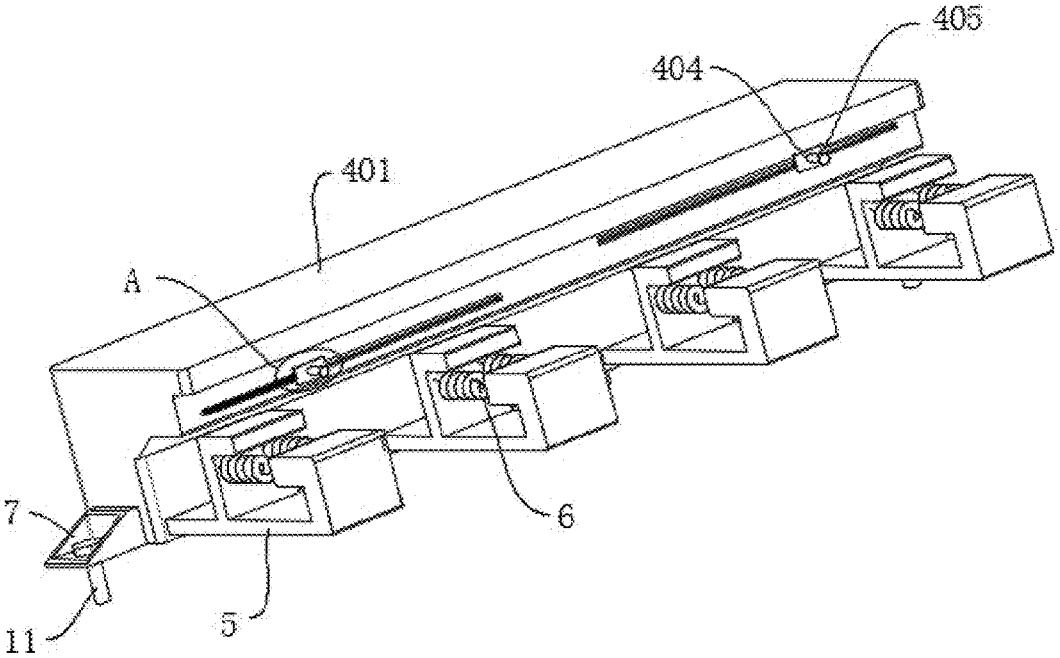
FIG. 2 is a schematic diagram of the structure of the adjustment component of the present disclosure.
Figure 3:
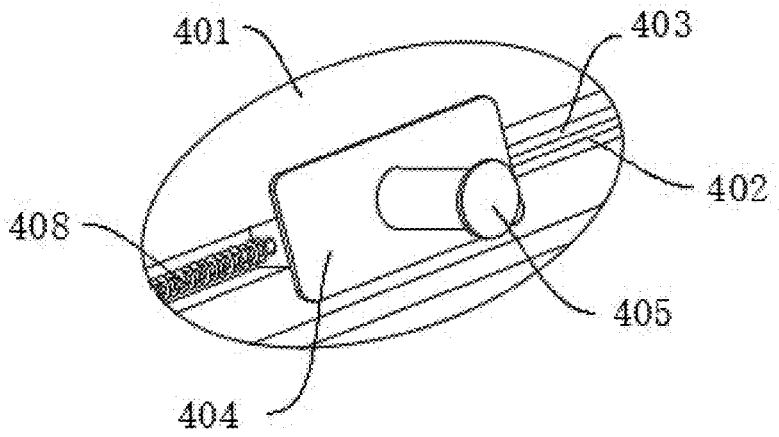
FIG. 3 is an schematic diagram of the enlarged structure at position A of the present disclosure.
Figure 4:
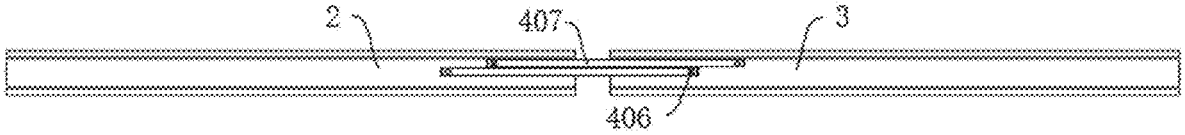
FIG. 4 is a schematic diagram of a connection structure of a first rail and a second rail of the present disclosure.

As shown in FIG. 2, two groups of clamping plates 5 are fixedly connected to the bottom end of the side plate 401, one group of the clamping plates 5 is connected to the first rail 2, and the other group of the clamping plate 5 is connected to the second rail 3, and each group of clamping plates 5 is equipped with two. The two groups of L-shaped resisting plates at the top ends of the clamping plates 5 clamp both sides of the bottom ends of the first rail 2 and the second rail 3, and further, the two groups of clamping plates 5 enhance the stability of clamping the first rail 2 and the second rail 3 by the L-shaped resisting plates.

Specifically, the clamping plate 5 includes a connecting plate and two L-shaped resisting plates which are connected into a whole, the connecting plate is fixedly connected with the side plate 401, the two L-shaped resisting plates are fixedly mounted on the upper surface of the connecting plate, and the two L-shaped resisting plates are respectively positioned on the inner side surface and the outer side surface of the first rail 2 and the second rail 3, and the height of the L-shaped resisting plates positioned on the inner sides of the first rail 2 and the second rail 3 is smaller than that of the L-shaped resisting plates positioned on the outer sides of the first rail 2 and the second rail 3, and the height of the inner L-shaped resisting plate is matched with thicknesses of the bottom edges of the first rail 2 and the second rail 3.

Specifically, the side springs 6 are respectively connected between the outer side of the first rail 2 and the L-shaped resisting plate and between the outer side of the second rail 3 and the L-shaped resisting plate; one end of the side spring 6 is welded on the side surface of the L-shaped resisting plate, and the other end of the side spring 6 is welded on the outer side surface of the first rail 2 and the outer side surface of the second rail. Two groups of side springs 6 are arranged, the two groups of side springs 6 are symmetrical with respect to the L-shaped resisting plate, the clamping plate 5 can fix the first rail 2 and the second rail 3 on the sleeper 1, when a train passes by, the first rail 2 and the second rail 3 can generate transverse movement and deformation, and at this time, the deformation generated by the side springs 6 can reduce the deformation radian of the first rail 2 and second rail 3.

Figure 5:
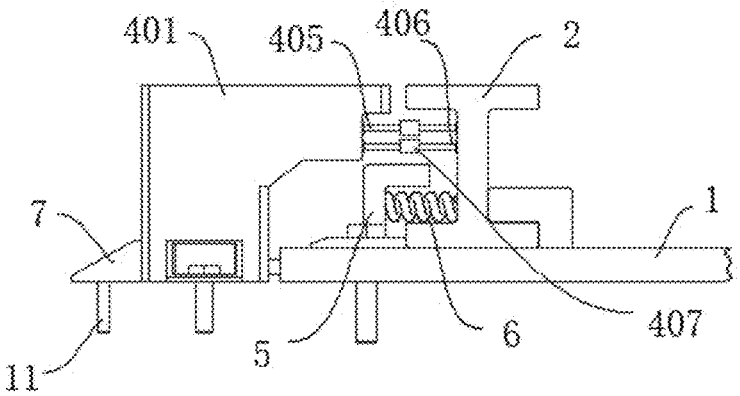
FIG. 5 is a side view of the connection of the adjustment component of the disclosure to a rail.
Figure 6:
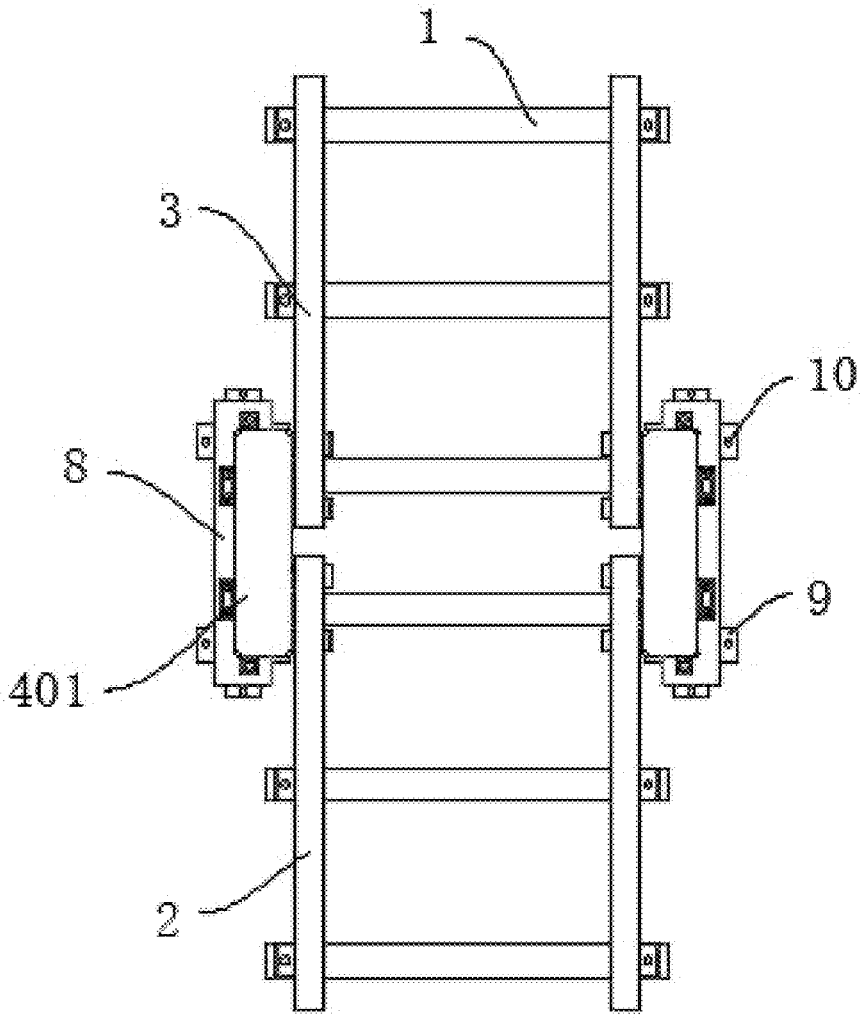
FIG. 6 is a top view of the whole structure of the present disclosure.

As shown in FIGS. 5-6, a plurality of fixed seats 7 are fixedly mounted on an outer side surface of a bottom of the side plate 401, the bottom end of the side plate 401 is mounted on the embedded part 8, and the fixed seats 7 are in threaded connection with embedded parts 8 through fixed bolts 11, the outer side of the embedded part 8 is fixedly connected with a plurality of clamping plates 9, the inside of the clamping plate 9 is connected with a clamping nail 10 in a sliding way; and the clamping plates 9 are fastened on roadbed through clamping nails 10. The provision of the embedded parts 8 enhance the stability of the connection between the side plate 401 and the ground.

The laying and mounting method of the rail temperature expansion joint as described above includes the following steps.

S1, measuring the mounting spacing between a first rail 2 and a second rail 3, and forming an embedded groove;

S2, mounting an embedded part 8 in the embedded groove;

S3, mounting an adjustment component 4 at the top end of the embedded part 8 in an alignment manner, and connecting a side plate 401 with the first rail and the second rail; and S4, mounting clamping plates 5 at the bottom ends of the first rail 2, the second rail 3 and the side plate 401, and mounting side springs 6.

Specifically, in S1, digging embedded grooves symmetrically on both sides of the junction of the first rail 2 and the second rail 3 according to the measured spacing, the depth of the embedded grooves is greater than the height of the embedded part 8; placing the embedded part 8 into the embedded groove and fixing the embedded part 8 into the embedded groove by utilizing a clamping nail 10, the front end of the clamp 10 is sharp, so that the clamp 10 is convenient to insert into the soil of the embedded groove; and then filling gravel cement and reserving a connecting hole; On the one hand, the gravel cement is filled to enhance the stability of the installation of the side plate 401, and on the other hand, the gravel cement effectively prevents the embedded part 8 from loosening in the embedded groove.

In S2, placing the side plate 401 in position above the embedded part 8, connecting the fixed bolt 11 in the fixed seat 7 connected with the outer end of the side plate 401 with the connecting hole reserved on the embedded part 8; the multiple groups of fixed seats 7 enhance the stability of the connection between the side plate 401 and the embedded part 8.

In S3, mounting connecting rods 407 into a first pillar 405 on an inner side of the side plate 401, as well as a second pillar 406 on an outer side of the first rail 2 and the second rail 3; the connecting rod 407 is detachable, which is convenient for regular replacement and maintenance.

In S4, clamping the clamping plate 5 at bottom sides of the first rail 2 and the second rail 3, and welding the side springs 6 between the first rail 2, the second rail 3 and an L-shaped resisting plate at a top end side of the clamping plate 5; the clamping plate 5 is connected with the first rail 2 and the second rail 3 in a clamping manner, which is convenient for installation, disassembly and later maintenance.

It should be noted that relational terms such as first and second and the like may be used herein only to distinguish one entity or operation from another entity or operation without necessarily requiring or implying any such actual relationship or order between such entities or operations. Furthermore, the terms "comprise", "include", or any other variation thereof, are intended to cover a non-exclusive inclusion, such that a process, method, article, or apparatus that includes a list of elements does not include only those elements but may include other elements not expressly listed or inherent to such process, method, article, or apparatus.

The above embodiments only describe the preferred mode of the present disclosure, and do not limit the scope of the present disclosure. On the premise of not deviating from the design spirit of the disclosure, various modifications and improvements made by ordinary technicians in the field to the technical solutions of the disclosure shall fall within the scope of protection defined in the claims.

The invention claimed is:

1. A rail temperature expansion joint, comprising: a sleeper, wherein an upper surface of the sleeper is symmetrically mounted with two first rails and two second rails, and the first rail and the second rail on one side are arranged on a same straight line; a gap is arranged between end faces of the first rail and the second rail; adjacent ends of the first rail and the second rail are fastened and positioned by an adjustment component, the adjustment component is fixedly mounted on an embedded part, and the embedded part is located at an outer side of the first rail and the second rail;

the adjustment component comprises a side plate, two sliding grooves, a support rod, a sliding plate, a first pillar, a second pillar, a connecting rod and a buffer spring; the side plate is arranged on the outer side of the first rail and the second rail; an inside of the side plate is provided with the two sliding grooves, an inside of each of the two sliding grooves is fixedly connected with the support rod, an outer peripheral surface of the support rod is sleeved with the sliding plate and the buffer spring; the sliding plate is mounted in an inner cavity of each of the two sliding grooves in a sliding manner, a first end of the buffer spring is fixedly connected inside each of the two sliding grooves, a second end of the buffer spring abuts against the sliding plate, and an outer side surface of the sliding plate is fixedly connected with the first pillar; an outer side surface of the first rail and an outer side surface of the second rail are fixedly connected with the second pillar, and the first pillar and the second pillar at a same height are sleeved with the connecting rod.

2. The rail temperature expansion joint according to claim 1, wherein two connecting rods are provided and are arranged in parallel up and down.

3. The rail temperature expansion joint according to claim 1, wherein two groups of clamping plates are fixedly connected to a bottom end of the side plate, a first group of the clamping plates of the two groups of clamping plates is connected to the first rail, a second group of the clamping plates of the two groups of clamping plates is connected to the second rail, and each group of clamping plates of the two groups of clamping plates comprises two clamping plates.

4. The rail temperature expansion joint according to claim 3, wherein each clamping plate of the two groups of clamping plates comprises a connecting plate and two L-shaped resisting plates, wherein the connecting plate and the two L-shaped resisting plates are connected into a whole, the connecting plate is fixedly connected with the side plate, the two L-shaped resisting plates are fixedly mounted on an upper surface of the connecting plate, and the two L-shaped resisting plates are respectively positioned on an inner side surface and an outer side surface of the first rail and the second rail, and a height of the L-shaped resisting plates positioned on the inner sides of the first rail and the second rail is smaller than a height of the L-shaped resisting plates positioned on the outer sides of the first rail and the second rail, and the height of the L-shaped resisting plates on the inner sides of the first rail and the second rail is matched with thicknesses of bottom edges of the first rail and the second rail.

5. The rail temperature expansion joint according to claim 4, wherein side springs are respectively connected between the outer side of the first rail and the L-shaped resisting plate and between the outer side of the second rail and the L-shaped resisting plate; a first end of the side spring is welded on a side surface of the L-shaped resisting plate, and a second end of the side spring is welded on the outer side surface of the first rail and the outer side surface of the second rail.

6. The rail temperature expansion joint according to claim 5, wherein a plurality of fixed seats are fixedly mounted on an outer side surface of a bottom of the side plate, and the plurality of fixed seats are in threaded connection with the embedded part through fixed bolts.

7. The rail temperature expansion joint according to claim 6, wherein an outer side of the embedded part is fixedly connected with a plurality of clamping plates, and the plurality of clamping plates are fastened on roadbed through clamping nails.

8. A laying and mounting method of the rail temperature expansion joint according to claim 1, comprising:

S1, measuring a mounting spacing between the first rail and the second rail, and forming an embedded groove;

S2, mounting the embedded part in the embedded groove;

S3, mounting the adjustment component at a top end of the embedded part in an alignment manner, and connecting the side plate with the first rail and the second rail; and S4, mounting clamping plates at bottom ends of the first rail, the second rail and the side plate, and mounting side springs.

9. The laying and mounting method of the rail temperature expansion joint according to claim 8, further comprising:

in S1, digging embedded grooves symmetrically on both sides of a junction of the first rail and the second rail according to a measured spacing, wherein a depth of the embedded grooves is greater than a height of the embedded part; placing the embedded part into the embedded groove and fixing the embedded part into the embedded groove by utilizing a clamping nail, then filling gravel cement and reserving a connecting hole;

in S2, placing the side plate in position above the embedded part, and connecting a fixed seat to the connecting hole reserved on the embedded part through a fixed bolt;

in S3, mounting the connecting rods into a first pillar on an inner side of the side plate and a second pillar on an outer side of the first rail and the second rail; and in S4, clamping a clamping plate at bottom sides of the first rail and the second rail, and welding the side springs between the first rail, the second rail and an L-shaped resisting plate at a top end side of the clamping plate.

10. The laying and mounting method of the rail temperature expansion joint according to claim 8, wherein in the rail temperature expansion joint, two connecting rods are provided and are arranged in parallel up and down.

11. The laying and mounting method of the rail temperature expansion joint according to claim 8, wherein in the rail temperature expansion joint, two groups of clamping plates are fixedly connected to a bottom end of the side plate, a first group of the clamping plates of the two groups of clamping plates is connected to the first rail, a second group of the clamping plates of the two groups of clamping plates is connected to the second rail, and each group of clamping plates of the two groups of clamping plates comprises two clamping plates.

12. The laying and mounting method of the rail temperature expansion joint according to claim 11, wherein each clamping plate of the two groups of clamping plates comprises a connecting plate and two L-shaped resisting plates, wherein the connecting plate and the two L-shaped resisting plates are connected into a whole, the connecting plate is fixedly connected with the side plate, the two L-shaped resisting plates are fixedly mounted on an upper surface of the connecting plate, and the two L-shaped resisting plates are respectively positioned on an inner side surface and an outer side surface of the first rail and the second rail, and a height of the L-shaped resisting plates positioned on the inner sides of the first rail and the second rail is smaller than a height of the L-shaped resisting plates positioned on the outer sides of the first rail and the second rail, and the height of the L-shaped resisting plates on the inner sides of the first rail and the second rail is matched with thicknesses of bottom edges of the first rail and the second rail.

13. The laying and mounting method of the rail temperature expansion joint according to claim 12, wherein the side springs are respectively connected between the outer side of the first rail and the L-shaped resisting plate and between the outer side of the second rail and the L-shaped resisting plate;

a first end of the side spring is welded on a side surface of the L-shaped resisting plate, and a second end of the side spring is welded on the outer side surface of the first rail and the outer side surface of the second rail.

14. The laying and mounting method of the rail temperature expansion joint according to claim 13, wherein a plurality of fixed seats are fixedly mounted on an outer side surface of a bottom of the side plate, and the plurality of fixed seats are in threaded connection with the embedded part through fixed bolts.

15. The laying and mounting method of the rail temperature expansion joint according to claim 14, wherein an outer side of the embedded part is fixedly connected with a plurality of clamping plates, and the plurality of clamping plates are fastened on roadbed through clamping nails.

* * * * *